United States Patent [19]

Jones

[11] 4,399,338

[45] Aug. 16, 1983

[54] AUTOMATIC FLOAT SWITCH

[75] Inventor: Clarence L. Jones, Ft. Pierce, Fla.

[73] Assignee: Ocean Research Industries of North America, Ft. Pierce, Fla.

[21] Appl. No.: 304,599

[22] Filed: Sep. 22, 1981

[51] Int. Cl.[3] ..... H01H 35/18

[52] U.S. Cl. ..... 200/84 R; 73/318; 73/322.5; 340/625; 200/81.6

[58] Field of Search ..... 73/308, 313, 317, 318, 73/322.5; 340/618, 620, 623, 625; 200/84 R, 84 B, 81.9 HG, 81.6, 61.2

[56] References Cited

U.S. PATENT DOCUMENTS

| | | | |
|---|---|---|---|
| 3,259,981 | 7/1966 | Raymond | 30/289 |
| 3,440,375 | 4/1969 | Wood | 200/84 B |
| 3,483,341 | 12/1969 | Reichensperger | 200/84 R |
| 3,702,910 | 11/1972 | Akeley | 200/84 R |
| 3,890,478 | 6/1975 | Riddel | 340/623 |
| 3,944,770 | 3/1976 | Pepper | 200/84 R |

*Primary Examiner*—G. P. Tolin

*Attorney, Agent, or Firm*—Sixbey, Friedman & Leedom

[57] ABSTRACT

A mercury activated float switch comprises a base member, a resilient fulcrum, desirably comprising an aperture in a resilient sheet, supported on said base member and at least two flexible electrical current carrying conductors supported for pivotal movement about the resilient fulcrum. A float member has associated therewith a switch assembly in which the electrical conductors terminate as spaced apart contacts. An angled mercury-containing race within the float member communicates with the switch assembly. As the liquid level changes, the float member pivots about the resilient fulcrum between first and second positions. The mercury in the race occupies the end of the race remote from the switch assembly when the float member is in its first position and flows into the switch assembly to bridge the space between the contacts when the float member is in its second position.

10 Claims, 6 Drawing Figures

AUTOMATIC FLOAT SWITCH

BACKGROUND OF THE INVENTION

1. Field of the Invention

The present invention relates to float switches and, more particularly, to dependable, non-fouling mercury-activated float switches.

2. Desciption of the Prior Art

Float switches of numerous configurations have been used for various marine and industrial applications. Such switches typically include a base member having mounted thereon a buoyant arm or float member. Electrical circuit and switch means are associated with the arm or member and are responsive to the angular position thereof, whereby the electrical switch means opens and closes as the angular position varies. Typically, changes in the angular position of the arm or member due to changes in water level cause an electrically conductive ball or fluid, such as mercury, to move between switch ON and switch OFF positions to permit or preclude the flow of current through the electrical circuit means.

Float switches of this nature are commonly used in marine environments and are adapted to interrupt or permit current flow, e.g., to a buoy or a pump in a ship's bilge, in response to changing water level. Unfortunately, float switches used in marine environments often malfunction when the mechanical linkage serving as the fulcrum between the buoyant arm or float member and the base member is restricted or obstructed. Typical arms and floats are mechanically linked to the base member by a variety of devices such as pins, rods, shafts, hinges, clamps and the like. U.S. Pat. No. 3,259,981 is exemplary of such a device wherein a lever arm is pivoted on a shaft-type fulcrum which is rotatable in its mounting means. When marine growth such as barnacles, fish slime or fish scales, various types of oils or other forms of foreign matter deposit on or otherwise cling to or obstruct the mechanical linkage, the fulcrum mechanism becomes restricted and causes the switch to stick. When used with a pump, for example, if the switch sticks in the "on" position the pump will not deactivate and the battery or other power source therefor will be depleted. If the switch sticks in the "off" position, the pump will not activate and damage to or loss of the ship due to high water levels may result. One solution to this problem, disclosed in U.S. Pat. No. 3,440,375 to Wood, utilizes a fixed, rigid clamping means engaging a flexible electrical cable as the fulcrum for pivoting a float type mercury switch between ON and OFF positions at the end of the cable. Although the clamp disclosed in the Wood patent is not readily susceptible of either corrosion or obstructive restriction in its operation, the arrangement is undesirable at best since the rigid clamping means contributes to malfunctions by causing the flexible electrical cable to wear and crack at the fulcrum point.

SUMMARY OF THE INVENTION

It is, therefore, an object of the present invention to provide a new and improved automatic float switch which is adapted to dependably function in marine environments.

It is another object of the present invention to provide a new and improved automatic float switch utilizing electrical conductors supported in a resilient, foul-proof fulcrum.

It is a further object of the present invention to provide a new and improved automatic float switch having adjustable and separable ON-OFF positions wherein flexible electrical conductors are pivotally supported in a resilient, foul-proof fulcrum not susceptible of corrosion or obstruction and which will not cause the conductors to wear at the pivot point.

Other objects and advantages will become apparent from the following description and appended claims.

In accordance with the foregoing objects the present invention provides an automatic float switch, preferably of the mercury activated type, which is useful in numerous applications, for example, as the switch in a flashing buoy marker, as a bilge pump activator, and the like. The switch comprises a body or base member supporting a foul proof resilient fulcrum means. Electrical conductors are supported in and pivot around the resilient fulcrum means and terminate within a plug as spaced apart electrical contacts. The plug seals one end of a mercury race housed within a float member. In operation, the float member rises and falls as the water level rises and falls. The position of the float member and the configuration of the race determines whether the switch is ON or OFF. In a first range of float positions, corresponding to predetermined water levels, the mercury is situated within the race at the end remote from the electrical contacts. In a second range of float positions, the mercury is situated within the race at the opposite end where it deposits in a puddle closing the circuit between the spaced apart electrical contacts. Desirably, the race is angled in order that the switch cycles between its ON and OFF positions at distinctly different water levels. A particularly desirable aspect of the present invention is the utilization of a resilient fulcrum means to serve as the pivot point for the rising and falling movement of the float member. In a preferred form of the invention the resilient fulcrum means comprises a pad, sheet or piece of resilient material, an aperture defined in the sheet or piece for passing the electrical conductors therethrough and mounting or support means for the sheet or piece.

DESCRIPTION OF THE PREFERRED EMBODIMENTS

Figure 6:
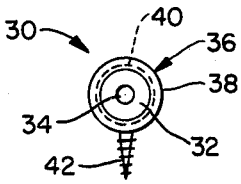
FIG. 6 is an elevational view of one form of resilient fulcrum means useful with the float switch assembly of the present invention.

Referring to the drawings, and particularly to FIGS. 1–4, there is shown the automatic float switch 10 of the present invention. Switch 10 includes a base means 20 consisting essentially of a body member 22 which may be mounted upon a switch supporting surface in a stable position. Thus, for example, member 22 may be affixed by screw threads, adhesive and/or any other known means to the vessel or other environment in which it is being employed to regulate or respond to changing water levels. A mounting adapter 24 is preferably supported within body means 22 for threadable movement axially into and out of the body member 22 to permit adjustment of the precise position of the float switch relative to the supporting surface. Supported on adapter 24, such as by screw threaded engagement therewith, is resilient fulcrum means 30. In a preferred embodiment, shown in FIG. 6, the resilient fulcrum means 30 comprises a resilient sheet or pad 32 having a central aperture 34 formed therein, such as a rubber, neoprene or other resilient grommet. A mounting means 36 supports the resilient sheet or pad 32 and screw threadedly engages and is itself supported on adapter 24. Thus, mounting means 36 may resemble a conventional screw eye, having a peripheral flange 38 which is formed to a shape suitable for engaging the outer edges of resilient sheet 32 within a recess 40 formed within the inner surface of flange 38. A threaded connector 42 extends from a point along the outer surface of flange 38 into threaded engagement with adapter 24. Desirably, a spacer member 26, such as a neoprene, rubber or plastic ring or apertured plug, surrounds the exposed threads of connector 42 between adapter 24 and flange 38 to protect the threads from the marine or industrial environment and against physical damage and to space the electrical conductors 54,56 passing through aperture 34 from adapter 24 to preclude abrasion of the conductor insulation.

A flexible, silicone rubber insulated electrical cable 52 comprising at least two separate silicone rubber insulated electrical conductors 54,56 passes through aperture 34 in resilient sheet 32. The conductors are electrically connected at one end to a power source (not shown) and to the bilge pump, buoy or other device (not shown) for which switch 10 serves as an electrical current flow regulator. At their other end, conductors 54,56 terminate in electrical contacts 58,60, respectively, which are embedded, respectively, within plugs 62,64. The plugs 62,64, are preferably of a plastic material which can seal around the electrical conductors and contacts and render them air and watertight when plugs 62,64 are sealed, as by adhesive bonding, into opposite straight through arms 72,74 of hollow T-adapter 70 as spaced apart electrical contacts. The perpendicular leg 76 of T-adapter 70 serves as a hollow plug to seal the open end 98 of a mercury race 90 formed within float member 80. In this manner, leg 76 of T-adapter 70 becomes an extension of race 90 to allow the mercury therein to flow into the T-adapter and deposit as a puddle at the base 78 of the T-adapter between plugs 62,64, thereby completing the open electrical circuit between spaced apart electrical contacts 58,60. The float member 80 rises and falls as the water level rises and falls causing the float member 80, T-adapter 70, plugs 62, 64 and electrical conductors 54,56 to pivot around the resilient fulcrum point defined by the aperture 34 in resilient sheet 32 in a pivotal plane passing substantially through cable 52, aperture 34, the space between contacts 58,60 and race 90. Preferably, electrical conductors 54,56 separate after passing through aperture 34, diverge in substantially opposite directions from the pivotal plane and then enter arms 72,74 of T-adapter 70 from opposite directions in a direction substantially normal to the pivotal plane, thereby defining a generally yoke-shaped conductor arrangement, as can best be seen in FIGS. 1 and 3. It has been found that such an arrangement helps stabilize the rising and falling movement of float member 80 within the pivotal plane and, thereby, reduces frictional contact of cable 52 with the resilient sheet 32.

Float member 80 consists of a molded plastic assembly which may be formed of any well known floatable material and preferably consists of a first half section **80*a* and a second half section 80*b*. Each half section has formed or molded within it a concave depression or recess in the form of and approximately one-half the diameter and circumference of race 90. The sections 80*a* and 80*b* may be assembled with the half sections of race 90 in registry and then joined and sealed with any well known adhesive to form an airtight and watertight bond. At least one end 98 of race 90 communicates with the surface of float member 80 to receive leg 76 of T-adapter 70 therein. In one convenient configuration, end 98 of race 90 is of slightly larger diameter than the remainder of race 90 defining a shoulder 92 against which the end 77 of leg 76 may abut when leg 76 is inserted within open end 98. In this manner the inner wall 79 of leg 76 and the inner wall 91 of race 90 form a substantially continuous surface for movement of the mercury in the race thereover. Leg 76 may be maintained in watertight and airtight engagement with open end 98 by any well known means, such as by threaded engagement, frictional engagement, adhesive engagement, etc., with or without the use of resilient sealing members, such as O-rings and the like, as is well known. Preferably, the engagement between leg 76 and open end 98 is readily separable to permit the easy separation of float member 80 from T-adapter 70**. In this way the float member in use on any particular automatic float switch may be readily exchanged for another float member, as conditions require, within removing the float switch from its mountings or disconnecting any inplace electrical circuitry.

Race 90 extends in a generally radial direction relative to the axis of pivotal movement A—A (see FIGS. 1 and 3) of float member 80, T-adapter 70, plugs 62,64 and electrical conductors 54,56. The race includes first and second generally cylindrical elongated race arms 93,94 disposed at an angle 96 to, and communicating with, one another at their intersection 97. First race arm 93 extends from open end 98 to the intersection 97 of the arms and second race arm 94 extends from the intersection 97 to the extreme end 99 of race 90 within the body of float member 80. For convenience of description, angle 96 is defined to be the included angle between first and second arms 93,94 and may vary from 90° to less than 180°. It will be appreciated that as angle 96 approaches 90° the water level height necessary to cause the mercury 100 in race 90 to flow from extreme end 99 of second arm 94 through intersection 97 and, by gravity, through first arm 93 to base 78 of T-adapter 70 to close the electrical switch also increases. Thus, the water level change necessary to cause the switch to cycle between its OFF and ON positions can be increased by decreasing race angle 96 from less than 180° toward 90°. Moreover, since the mercury flowpath between first and second arms 93,94 must be over the intersection angle 96, there are provided distinctly separable ON and OFF positions to alleviate the problems associated with commonly used mercury switches wherein even the slightest changes in water level causes the mercury to move toward or away from the spaced apart contacts, resulting in undesirably rapid intermittent starting and stopping of current flow to the device with which the switch is used. Moreover, the ability to control switch ON and OFF position by altering the angle 96 of race 90 is particularly useful in connection with the present invention since it is a relatively simple matter to remove one float member 80 from T-adapter leg 76 and replace it with another float member 80 having a more desirable race angle.

Figure 1:
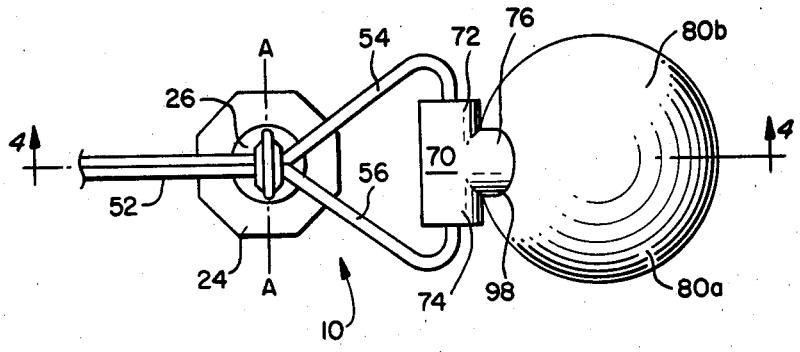
FIG. 1 is a plan view of the float switch assembly of the present invention.
Figure 2:
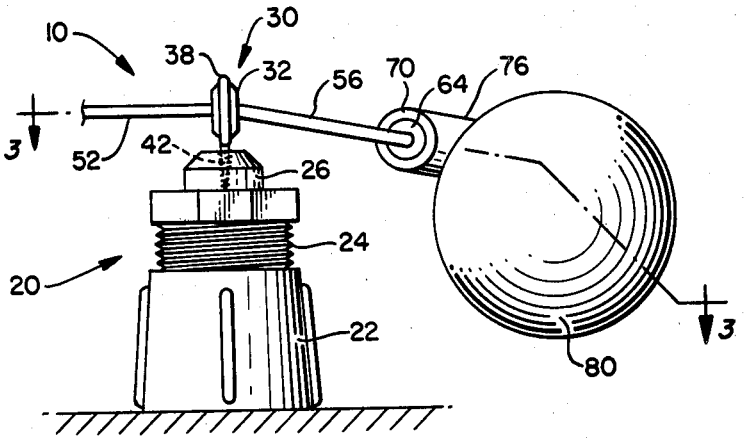
FIG. 2 is an elevational view of the float switch assembly of the present invention.
Figure 3:
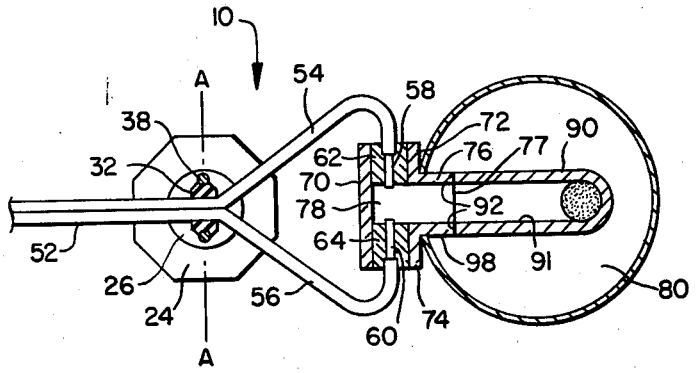
FIG. 3 is a sectional view taken substantially along line 3—3 in FIG. 2.
Figure 4:
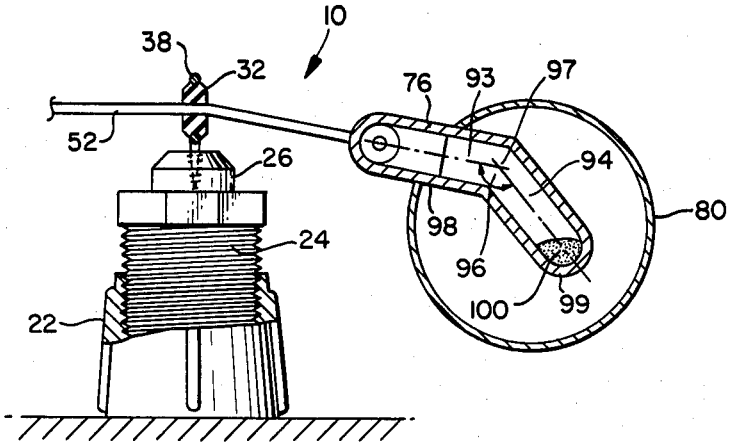
FIG. 4 is a sectional view taken substantially along line 4—4 in FIG. 1.
Figure 5:
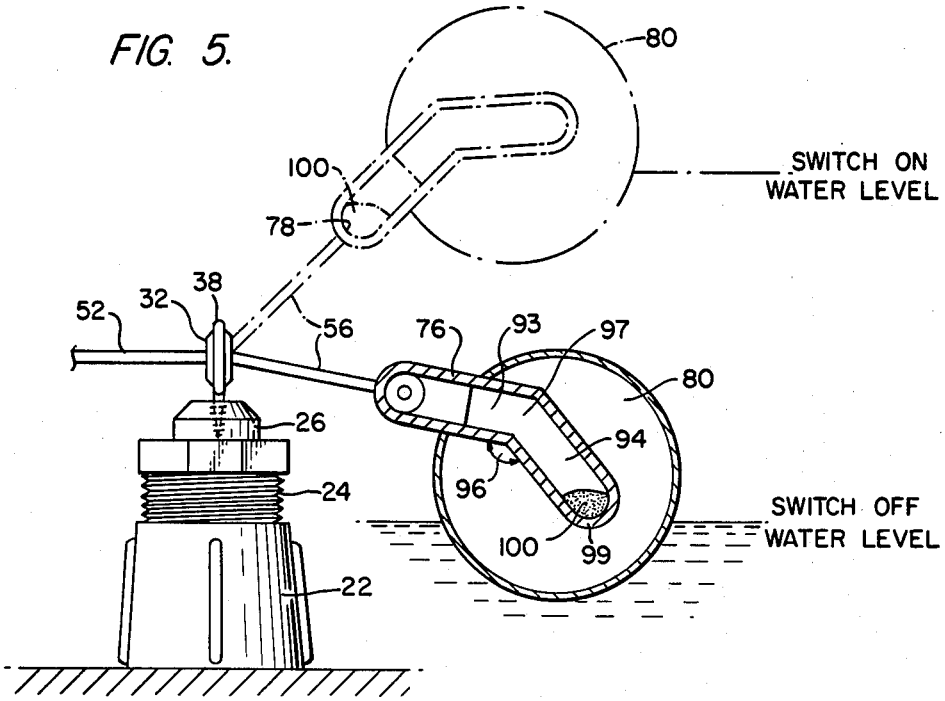
FIG. 5 is an elevational view, partly in section, of the float switch assembly of the present invention showing, in solid lines, the assembly in a switch open position and, in broken lines, the assembly in a switch closed position.

The operation of the automatic float switch 10 of the present invention will be apparent from a consideration of FIG. 5. When float member 80 is in a first position, corresponding to a switch OFF position, as illustrated in solid lines in FIG. 5, the puddle of electrically conductive mercury is situated in the extreme end 99 of second arm 94 of race 90. In this position no current can flow in the open electrical circuit which includes spaced apart electrical contacts 58,60. As the water level rises, float member 80 also rises. However, gravity maintains the mercury globule in extreme end 99 and the switch remains open until a water level is reached which is high enough to cause the globule of mercury to flow by gravity along second arm 94, over angle 96 and through intersection 97, along and through first arm 93, through open end 98 into leg 76 of T-adapter 70 and to settle in a puddle at the base 78 of T-adapter 70 between plugs 62,64 to complete the electrical circuit which includes spaced-apart contacts 58,60. In this position, illustrated in broken lines in FIG. 5, current can flow in the circuit to the device with which switch 10 is used and current will continue to flow until the water level drops sufficiently that the mercury globule will flow by gravity back through leg 76, open end 98, first arm 93, intersection 97 and second arm 94 to extreme end 99, thereby again opening the circuit.

While the present invention has been described with reference to particular embodiments thereof, it is to be understood that the invention is not limited in its application to the details of construction and arrangement of parts illustrated in the accompanying drawings, since the invention is capable of other embodiments and of being practiced or carried out in various ways. Also, it is to be noted that the phraseology or terminology employed herein is for the purpose of description and not limitation. Accordingly, all modifications and equivalents may be resorted to which fall within the scope of the invention as claimed.

I claim:

1. An automatic float switch for controlling the flow of electrical current to an electrical device in response to changing liquid levels comprising:

(a) base means;

(b) resilient fulcrum means supported on said base means;

(c) flexible electrical current carrying means supported for pivotal movement about said fulcrum means, said current carrying means comprising at least two electrical conductors;

(d) a float member including an electrical switch assembly and an angled race, said conductors terminating within said switch assembly as spaced apart electrical contacts, said race having one end communicating with said switch assembly and the other end remote from said switch assembly within said float member, said float member adapted to pivot about said fulcrum means between first and second positions in response to changing liquid levels; and (e) electrically conductive flowable material within said race for flow therealong between the ends thereof, said material occupying said remote end of said race when said float member is in a first position and flowing into said switch assembly when said float member is in a second position, whereby said material bridges said space between said spaced apart contacts in said switch assembly to permit current flow to said electrical device.

2. A float switch, as claimed in claim 1, wherein said resilient fulcrum means comprises a resilient material, means supporting said resilient material on said base means and an aperture defined in said material, said flexible current carrying means passing through said aperture.

3. A float switch, as claimed in claims 1 or 2, wherein said float member includes an opening defined in the surface thereof, said race has one end communicating with said opening and said electrical switch assembly includes a portion received within said opening for communicating said one end of said race with said switch assembly.

4. A float switch, as claimed in claim 3, including means for releasably receiving said electrical switch assembly portion within said opening whereby said float member is separable from said switch assembly for changing float members as desired.

5. A float switch, as claimed in claim 3, wherein said switch assembly includes a reservoir for receiving said electrically conductive flowable material and means for terminating said spaced apart electrical contacts within said reservoir.

6. A float switch, as claimed in claim 5, wherein said switch assembly comprises a substantially T-shaped housing, means for mounting at least one electrical conductor in each of the opposite straight through arms of said T-shaped housing with said electrical contacts in facing, spaced apart relationship and means for receiving said perpendicular leg of said T-shaped housing within said opening in said float member.

7. A float switch, as claimed in claim 6, wherein said means for mounting comprises plug means through which said conductors extend into said T-shaped housing, whereby the base of said T-shaped housing opposite said perpendicular leg and between said plug means comprises said reservoir.

8. A float switch, as claimed in claim 6, wherein said race, spaced apart electrical contacts and resilient fulcrum means generally define a plane in which said float member pivots about said fulcrum as it moves between its first and second positions, said electrical conductors diverge from said pivotal plane in substantially opposite directions as they extend between said fulcrum means and said switch assembly and enter said straight through arms of said T-shaped housing from substantially opposite directions and in directions substantially normal to said pivotal plane, whereby sad conductors between said fulcrum means and said switch assembly assume a generally yoke-shaped arrangement.

9. A float switch, as claimed in claim 8, wherein said race comprises first and second generally elongated, hollow arms, each said arm having one end intersecting an end of the other arm within said float member at an included angle between said arms of from 90° to less than 180°, the non-intersecting end of said first arm communicating with said switch assembly and the non-intersecting end of said second arm being remote from said switch assembly within said float member.

10. A float switch, as claimed in claim 2, wherein said race comprises first and second generally elongated, hollow arms, each said arm having one end intersecting an end of the other arm within said float member at an included angle between said arms of 90° to less than 180°, the non-intersecting end of said first arm communicating with said switch assembly and the non-intersecting end of said second arm being remote from said switch assembly within said float member.

* * * * *